United States Patent [19]

Rains et al.

[11] 4,209,259

[45] Jun. 24, 1980

[54] MAGNETIC MIXER

[76] Inventors: Robert L. Rains, 11542 Andasol Ave., Granada Hills, Calif. 91344; Larry R. Rathbun, Star Rte. Box 21 BBB, Hollister, Mo. 65616

[21] Appl. No.: 956,679

[22] Filed: Nov. 1, 1978

[51] Int. Cl.[2] ..... B01F 7/16

[52] U.S. Cl. ..... 366/273

[58] Field of Search ..... 366/273, 274, 342, 343; 64/28 M; 51/163.1, 163.2, 164

[56] References Cited

U.S. PATENT DOCUMENTS

| | | | |
|---|---|---|---|
| 3,113,228 | 12/1963 | Tolegian | 366/273 |
| 3,570,819 | 3/1971 | Rosinger | 366/274 |

FOREIGN PATENT DOCUMENTS

| | | | |
|---|---|---|---|
| 622115 | 4/1949 | United Kingdom | 366/274 |

*Primary Examiner*—Leonard D. Christian

*Attorney, Agent, or Firm*—Blakely, Sokoloff, Taylor & Zafman

[57] ABSTRACT

The present invention utilizes high magnetic flux materials to substantially increase the power which can be transmitted from a magnetic driver, disposed outside of a vessel containing a fluid being processed, to a magnetically responsive agitator means disposed inside the vessel. This invention now enables the agitation, e.g., mixing, blending, etc., of fluids processed in the pharmaceutical, chemical and food processing industries, where relatively high torques are encountered, by non-contaminating magnetic drive means heretofore precluded in such applications. Means for producing vibrational agitation, and for reducing wear of the internal agitator bearing are also disclosed.

12 Claims, 12 Drawing Figures

Fig. 5b
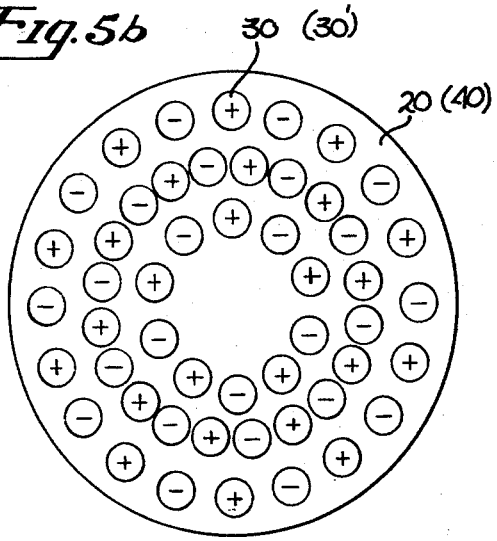
Fig. 5c
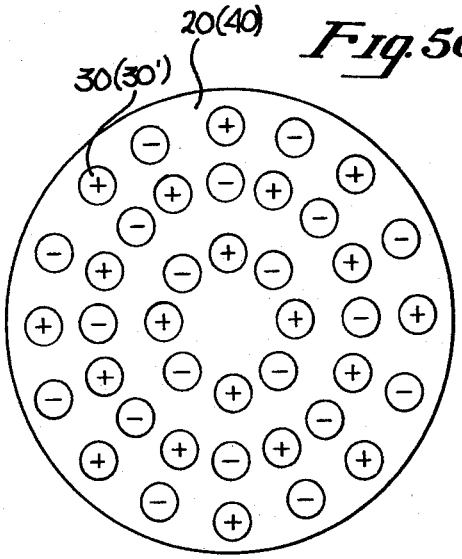
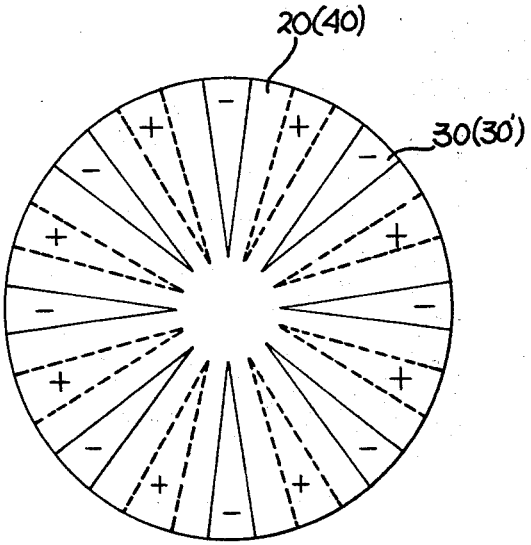
Fig. 5d
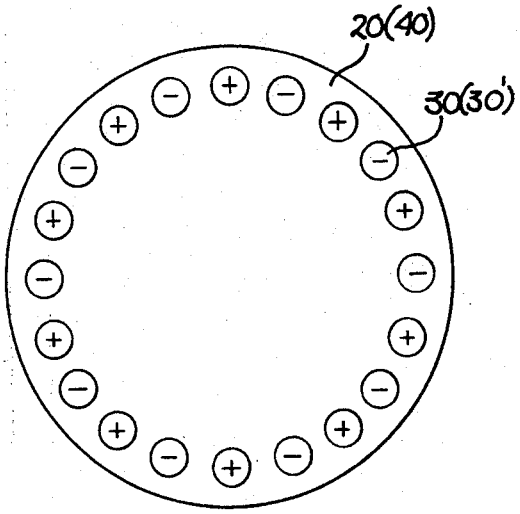
Fig. 5a
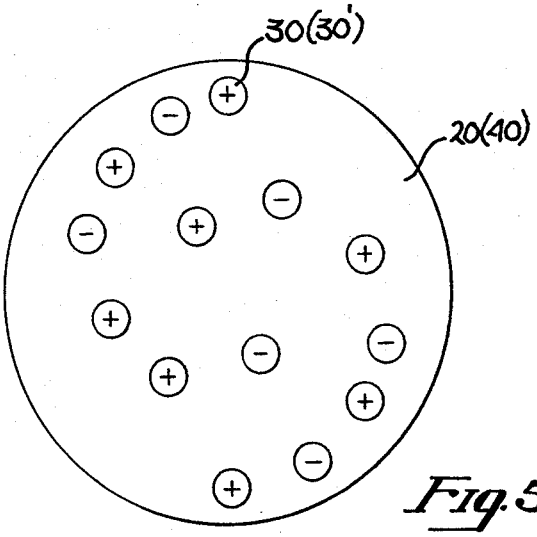
Fig. 5e

MAGNETIC MIXER

BACKGROUND OF THE INVENTION

1. Field of the Invention

This invention relates to magnetic driving means, and more particularly, to means for magnetically transmitting relatively high power torque to fluid agitation means located in process vessels, vats or tanks.

2. Description of the Prior Art

The agitation of fluids in vessels, vats and the like is required in the pharmaceutical, chemical, dairy, food processing and other industries. Various levels of agitation are commonly used, depending upon the application involved and the results sought. The various levels of agitation require corresponding levels of power to be provided to the agitation means.

The agitation of fluids which requires the least power is "stirring". The purpose of stirring is to facilitate the transfer of heat throughout the fluid in order to prevent "burn-on" or "freeze-on" thereof. "Mixing" is a higher level of agitation, typically required when two or more constituents which don't normally mix, e.g., oils or oil based ingredients, are to be dispersed uniformly throughout a fluid so as to go into solution or suspension therein. "Blending" is similar to mixing, but requires more power to the agitation means when the two or more constituents are dry and not readily soluble in the fluid involved. The blending operation causes some breaking down of the particle sizes. The next level of agitation, in the order of ascending power required, is "suspension" agitation. This higher level of agitation is typically required when the constituent particles, which are to be suspended or dissolved in the fluid, are relatively heavy particles. "Homogenizing" is an even higher level of agitation, used to further break down the particles of the constituents so as to cause them to remain in suspension homogeneously throughout the fluid. Lastly, the level of agitation requiring the greatest power is "dispersing" or "shearing". Dispersing imparts extremely high shearing forces to the fluid, approaching the forces normally encountered in a pumping action. Dispersing is also used to aerate the fluid in many, but not necessarily all, applications. It should be understood that there are no sharply defined power levels which uniquely separate and identify the foregoing kinds of agitation. Therefore, it is not uncommon that the terms described above, i.e., stirring, mixing, blending, etc., may sometimes be used interchangeably by those on the field.

The level of agitation one obtains, i.e., whether stirring, blending, etc., is a function of (i) the size and shape of the impellers, (ii) their particular location within the vessel, and (iii) their rate of rotation (r.p.m.). The power necessary to achieve a required rate of rotation of the impellers, in turn, is a function of (i) the viscosity of the fluid, (ii) the size and shape of the vessel, and (iii) to some extent, the design of the impellers.

In many applications, power levels of from 1–5 horsepower are required, depending upon the foregoing variables, for stirring, mixing, blending and suspension agitation. Even higher power levels, up to 10 horsepower, may be required for homogenizing and dispersing operations. In the prior art, driving the agitation means with power sufficient to achieve the required impeller r.p.m. has not been a problem; however, the various means known in the prior art for providing such power to the agitation means have several significant shortcomings and disadvantages.

In configurations of the prior art, a motor-driven shaft, having an impeller affixed to its end, is rotatably suspended into the vessel or vat through a sealed opening in the top thereof. A first problem introduced by such a configuration, and perhaps the most significant to the pharmaceutical, dairy and food processing industries, is that of contamination of the fluid in process. Contamination of the fluid results from (i) particulate matter flaking off from the seal (e.g., teflon from a diaphragm seal) due to the shearing forces of the rotating shaft, (ii) the impossibility of obtaining a perfect seal, that is, one which will prevent external contaminants, e.g., oil, from passing through it, and (iii) the accumulation of matter, e.g., protein, in the small spaces typically existing between the edge of the seal and the top of the vessel. In the latter instance, such accumulated protein matter is very difficult to clean out completely, and thereafter serves to support bacterial growth.

A second shortcoming and disadvantage of the above-described prior art configurations for providing adequate power to the agitation means is that it requires structural means for supporting the drive motor (which often weighs 70–80 pounds) on the top of the vessel. In addition, the structural means must be able to withstand the reactive torques imposed upon the drive motor. This obviously increases the cost of the installation. Moreover, the cost of cleaning the vessel is also increased significantly in that removal of the drive motor, its support structure, the seal configuration and the drive shaft from and through the top of the vessel must necessarily precede each cleaning operation. The total weight of the foregoing components in many installations is 300–400 pounds, often requiring use of a boom crane.

Yet another shortcoming and disadvantage of the prior art structures used to drive fluid agitation means relates to the fact that the size and shape of the impellers which may be driven by a drive shaft suspended from the top of the vessel are limited. This results in certain adverse consequences which are now discussed. The impellers in such an application must be highly balanced in order to prevent severe vibrations of the relatively long drive shaft, and its possible breakage under the severe loads encountered. This requirement is typically satisfied by the use of a propeller blade impeller, which can be balanced to the high degree required. However, while propeller blade type impellers can be varied in respect to their size and blade pitch, the requirement to use them imposes a significant limitation on the choice of impeller designs which would otherwise be available. A second adverse consequence of being limited to propeller blade impellers is that if they are located too close to the bottom of the vessel, they tend to "beat" or shear the fluid in process. When dispersing or shearing agitation is not desired in a particular application, the "beating" of the product has the effect of breaking it down, thereby rendering it non-usable, or with further processing, usable only for animals. In the latter case, however, the price of the product is less, while the cost of production is greater due to the additional processing required.

In order to avoid the beating of the fluid in process, the prior art teaches suspending the propeller blade impellers at least one propeller diameter above the bottom of the vessel, and no closer. Thus, for example, if the diameter of the propeller blades is 12 inches, then the blades are suspended at least that amount above the bottom of the vessel. This requirement results in yet another adverse consequence of being limited to propeller blade type impellers. This adverse consequence may occur when the product is drained from the vessel, typically by gravity flow through a port in the bottom. If the level of the fluid reaches the level at which the propeller blade impeller is located above the bottom of the vessel, and the agitation means is still in operation, then the product will be aerated. Aeration of the product usually destroys it or, as in the case of a sheared product, may render it useful only for animal consumption after further processing. This problem can be avoided either by stopping agitation of the product during its drainage from the vessel or, if this is not permissible, by closely monitoring the levels of the product as it drains. In many applications, however, particularly in the production of intravenous materials such as blood plasma, narcotics, pharmaceuticals, and saline, hemophil and proplex solutions, agitation must continue during drainage. Yet, effective monitoring of the descending level of the product is difficult in such application because these products are typically processed in sealed vessels. The use of external sight glasses is not effective due to the agitation of the fluid. To lower the propeller blades closer to the bottom of the vessel would substantially reduce losses due to aeration, but would correspondingly increase losses attributable to "beating" of the product. Thus, by the very nature of the propeller blade type impellers, which are required by the conventional means for driving the agitation means (i.e., a long, top-suspended drive shaft), there is no adequate solution to the dilemma of trading off the risk of aerating the product against the risk of beating it.

The foregoing problems can be avoided or overcome, as the case may be, by driving the agitation means magnetically. However, while magnetic drivers for agitating fluids are known in the prior art, they have been power limited, being able to transmit only a maximum of about ¼ horsepower. Thus, the magnetically driven fluid agitators of the prior art are unsuitable for the processing of fluids in commercial applications requiring drive power in excess of ¼ horsepower. The present invention overcomes this power limitation of the prior art magnetic agitators and enables their use in the high power applications encountered in the pharmaceutical, chemical and food processing industries.

Uses of the magnetic drivers (for fluid agitation) known in the prior art have been limited to small laboratory and household mixing, stirring and blending appliances. These are applications in which the vessels involved are small in volume, and the power required, usually less than ¼ horsepower, is compatible with the power capability of the available magnetic drivers. One such laboratory type agitator is shown by Eddy et al in U.S. Pat. No. 2,859,020. The invention comprises a collapsible agitator means 6, suitable for insertion into a laboratory vessel 26, mounted on a rotatable shaft 14. A permanent magnet 22 is affixed to the lower end of the shaft. The magnet 22 is driven by the magnetic force of a second permanent magnet 34, rotatably mounted to the shaft of a drive motor 31. Both the motor 31 and the second (drive) magnet 34 are located in a housing 28 on which the laboratory vessel 26 is seated. Other prior art laboratory applications of magnetic drives for fluid agitation are disclosed in the "Proceedings of the 1st International Symposium on Advances in Microbial Engineering," reported in the Interscience Publication of John Wiley & Sons, dated 1974, Part 2.

In the field of household appliances, Morrison discloses, in his U.S. Pat. No. 2,619,606, a magnetic power unit for a mixing, stirring, or homogenizing appliance. A magnetically susceptible keeper 23, disposed within the tumbler, is driven by externally located motor-driven permanent magnets 46. In U.S. Pat. No. 3,421,528, Gomez et al disclose a magnetically agitated dental cleaning device. Inside a cleaning bowl, a multivane rotor 46 is rotatably mounted on a central shaft 48. The base of the rotor has a pair of aligned bar magnets 50 embedded or encapsulated in it. A drive assembly, on which the bowl is placed, comprises a motor-driven bar magnet rotor 28 located in close proximity to the underside of the bowl and, therefore, to the multivane rotor 46 in the bowl. Rotation of the rotor 28 drives the multivane rotor, thereby causing agitation of a denture cleaning solution.

In a commercial application, U.S. Pat. No. 3,694,341 to Luck, Jr. discloses a magnetic mixer for stirring of photographic process film baths having a pair of opposed circular magnets 12 and 20 which are used to stir the bath without contact therebetween. A similar magnetic stirrer is shown in U.S. Pat. No. 3,758,274 to Ritchie et al for use in conjunction with a reagent reservoir.

The above-noted power limitation of prior art magnetically driven agitators has been due to the fact that heretofore only metallic, e.g., iron, bar magnets have been available to the trade. Metallic magnets are inherently limited with respect to the maximum flux they provide per cubic centimeter of material, thereby limiting the magnetic force which can be transmitted between the driving and driven magnetic elements. When more power, i.e., torque, is required than can be transmitted magnetically, the driven element will slip with respect to the driver. The problem of insufficient magnetic torque may be compounded due to flux loss in, and/or low magnetic conductivity of, the vessel wall which lies between the driving and driven elements. The latter factors are functions of the vessel wall material and its thickness. For example, magnetic agitation of fermenting wine has heretofore not been feasible because of the poor conduction of magnetic flux through the thick wooden vats used in the wine industry.

In U.S. Pat. No. 2,506,886, Okulitch et al disclose a means for accommodating, but not eliminating slippage between the driving and driven elements of a magnetically activated agitator for dairy products. Slippage occurs when the driver element, i.e., the agitator, encounters resistance in the fluid which requires more power than can be transmitted magnetically. Okulitch et al's invention comprises a (i) motor driven rotor 24 situated beneath and external to the vessel and carrying permanent magnets 26 on its periphery; and (ii) an agitator 36 containing impeller blades and a corresponding number of permanent magnets 47 spaced similarly to magnets 26. Rotor 24 and its shaft 20 are slidably mounted in a sleeve 17. The weight of the rotor 24 and its shaft 20 is materially less than the vertical force of the magnets 47 so that they are pulled upward by the agitator's magnets 47. Thus, any time when, due to high resistive forces encountered by the agitator 36, the rotor 24 ceases to drive the agitator, i.e., slippage occurs, the rotor and its shaft will be released and they will drop downward. Means are provided whereby the dropping motion of the rotor 24 causes power to its drive motor 28 to be switched off. This results in a slowing of the rotation of rotor 24 until the magnetic force between the two sets of magnets 26 and 47 can re-align them, thereby causing rotor 24 and its shaft 20 to again be pulled upward by the attraction of magnets 47. When this occurs, the power to the drive motor 28 is automatically switched on. This cycle is repeated automatically, each time giving further impetus to the agitator until the several magnets can maintain their load without separation. The present invention, by providing means for transmitting sufficiently high power for the loads required, renders unnecessary the inclusion of means for overcoming agitator slippage, such as that taught by Okulitch et al.

Insufficient magnetic force between the magnetic driver and the agitator means also limits the rate of rotation (r.p.m.) at which the agitation means can be driven. If the agitation means is driven at too high an r.p.m., it will tend to lift off its support bearing post and rise, helicopter style, into the vessel. Morrison, in his U.S. Pat. No. 2,546,949, attempts to overcome this speed limitation in a home blender by providing a configuration of two planetary gears 47 intermeshed with a ring gear 48 coupled between a magnetically driven element 44 and an impeller 62. By this configuration of gears, the impeller operates at a substantially higher r.p.m., in the order of 10,000 r.p.m., than could be produced by the magnetic driver itself. Of course, this approach is suitable only in applications where the torques encountered in the fluid being mixed or blended are not high. The present invention, on the other hand, by providing means for transmitting far greater magnetic torque than has heretofore been possible, enables higher agitator r.p.m.'s to be achieved directly by the magnetic driver, without the addition of the complex gearing of Morrison and its attendant decrease in the torque which the agitator can apply to the fluid.

The present invention advances the power transmission capability of magnetic driving devices by advantageously utilizing, in a variety of arrays, permanent magnets characterized by very high energy products and coercive forces. Suitable permanent magnets include ceramic magnets, available to the trade since the mid-1950's, and rare earth, cobalt magnets, more recently introduced. By virtue of their superior magnetic properties relative to permanent iron magnets of the same size, their utilization in the present invention enables it to transmit up to 3–4 horsepower, thereby making it suitable for many high power applications in the pharmaceutical, chemical and food processing industries. Thus, stirring, mixing and blending of fluids in relatively large vessels can now be accomplished by magnetic drive means. Suspending may also be possible with the present invention in some cases, depending upon the viscosity of the fluid and the size and shape of the vessel involved.

In view of the foregoing, the present invention avoids the problems, shortcomings and disadvantages of the prior art by eliminating the need to provide power to the agitator by means of a top-mounted driver and suspended drive shaft. As a result of eliminating the above-mentioned drive shaft, the cost and added weight of top-mounting the drive motor, and the additional cost in labor and equipment required to remove the same to enable vessel cleaning are also eliminated. Moreover, and very importantly, by driving the agitation means magnetically the need for penetrating the wall of the vessel and for providing sealing means to accommodate the drive shaft is eliminated. Thus, the problems of product contamination attributable to seal leakage and the difficulty of completely cleaning the seal are overcome.

Another highly significant advantage of the magnetic driver agitation means, attributable to the elimination of the relatively long, suspended drive shaft, is that it enables one to select from a wide variety of impeller shapes, sizes and configurations. The capability to select and/or design an impeller configuration specifically suited to a particular application, instead of being limited to the size and pitch of the blades of propeller blade type impellers, represents a significant advance over the prior art.

Lastly, by overcoming the limitation of having to use propeller blade type impellers, the non-blade impellers which can now be utilized may be disposed very close to the bottom of the vessel (usually in one of its four quadrants). As a consequence, the problems of product bearing and the risk of product aeration are effectively eliminated.

SUMMARY OF THE INVENTION

The present invention is adapted to magnetically drive a configuration of fluid agitating impellers located within, and typically at the bottom of, a vessel, vat or tank in which a fluid is being processed. It is particularly suited for use in application which require the transmission of up to 3–4 horsepower of power to the impellers. The invention comprises (i) a driver member, located external to the vessel, and having disposed within it an array of high energy product permanent magnets in a particular spaced and poled relation to one another; (ii) means for rotating the driver member, typically an electric motor; (iii) means for supporting the driver member and said rotating means; and (iv) a driven member located within the vessel and having disposed therein an array of high energy product permanent magnets in a particular spaced and poled relation to one another, and further, having disposed thereon impellers of a particular shape, size, and pitch. The driven member is rotatably or otherwise supported on the bearing affixed to vessel bottom. In one embodiment, a vessel plate is welded into the vessel bottom, which plate has a vertically disposed bearing on its side internal to the vessel and a flange extending downwardly on its external side. The bearing rotatably supports the driven member, whereas the flange provides the means for supporting the driver member and the rotation (motor) means from the vessel. In a second embodiment, useful in applications in which the vessel cannot be cut into in order to accommodate a vessel plate, the internally located bearing means, which rotatably supports the driven member, is held in place, in proper alignment with the axis of rotation of the driver member, by magnetic means.

Thus, it is a principal objective of the present invention to provide a means for magnetically transmitting relatively high power to agitation means immersed in a process fluid.

It is another principal object of this invention to provide, in high torque and r.p.m. applications, a means for agitating process fluids without penetration of the walls of the vessels containing said fluids, therefore, without contamination attributable to the drive means.

Another object of this invention is to eliminate the beating and aeration of the process fluid in high torque applications, and the economic losses attendant thereto, by overcoming the prior art limitation of having to use propeller type blade impellers.

Yet another object of the present invention is to enable, in high torque applications, the use of impellers having sizes, shapes and configurations optimumly designed or selected to achieve a particular result in a given application.

Other objects and advantages of the present invention will become apparent upon making reference to the following detailed description and the accompanying drawings. The description and the drawings will also further disclose the characteristics of this invention, both as to its structure and its mode of operation. Although preferred embodiments of the invention are described hereinbelow, and shown in the accompanying drawing, it is expressly understood that the descriptions and drawings thereof are for the purpose of illustration only and do not limit the scope of this invention.

BRIEF DESCRIPTION OF THE DRAWINGS

Preferred embodiments of the present invention are now described in detail with reference to the following drawings:

FIGS. 5*a* through 5*e* are top views depicting various configurations of the spacing and poling of magnets disposed in driver and driven members comprising this invention.

DETAILED DESCRIPTION OF THE INVENTION

In the following description of the invention, like elements of the invention will be designated by the same numerals in all Figures.

Figure 1:
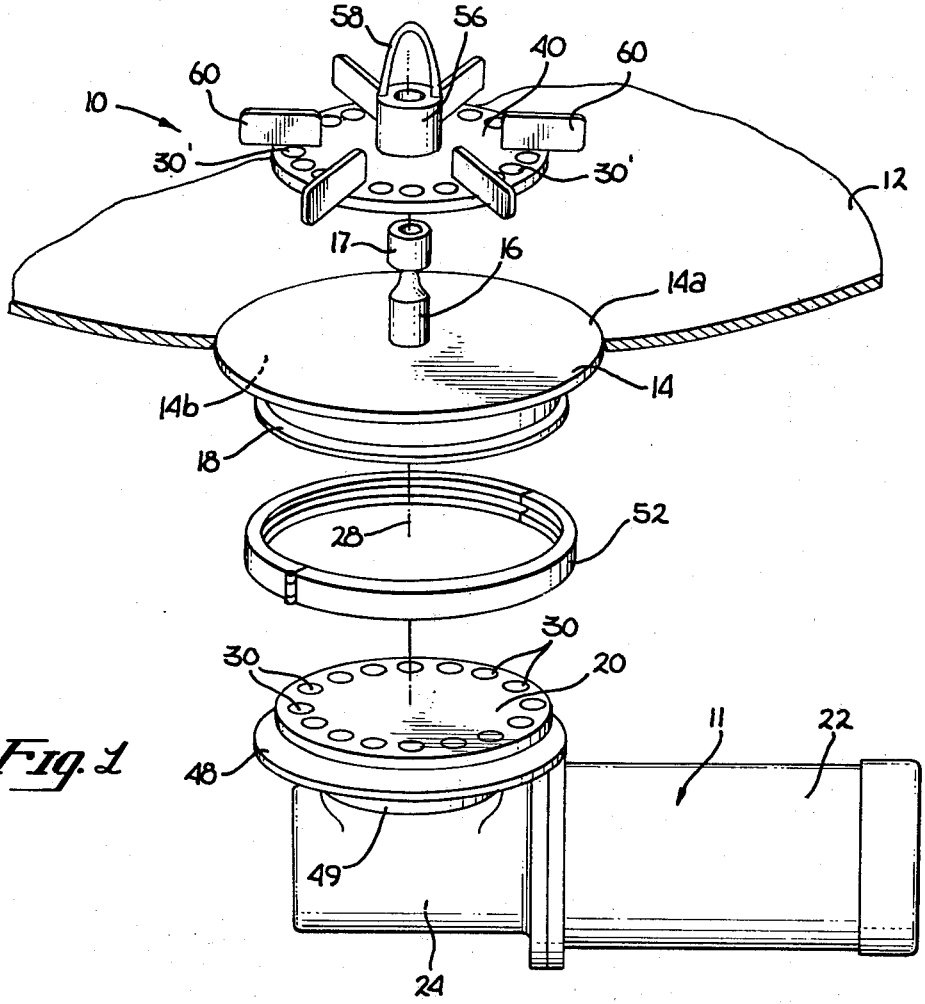
FIG. 1 is a perspective view of one embodiment of the present invention showing its basic components in spaced relation to one another.
Figure 2:
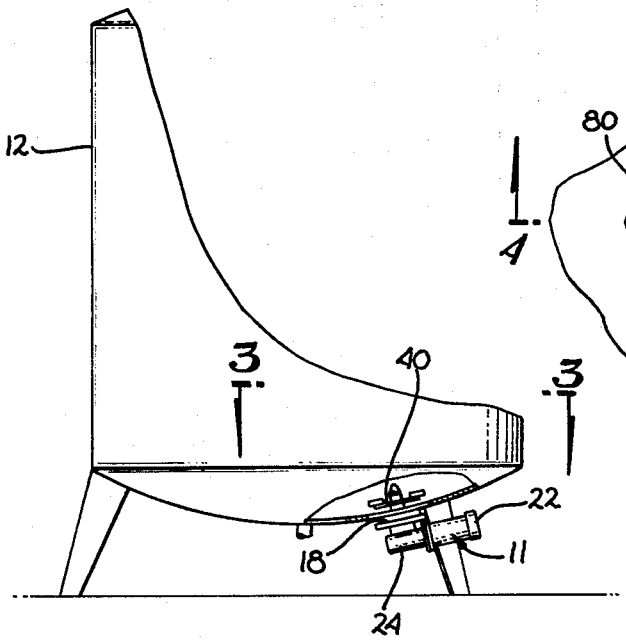
FIG. 2 is a partially broken away side elevation view of the invention installed in the bottom of a fluid processing vessel.
Figure 3:
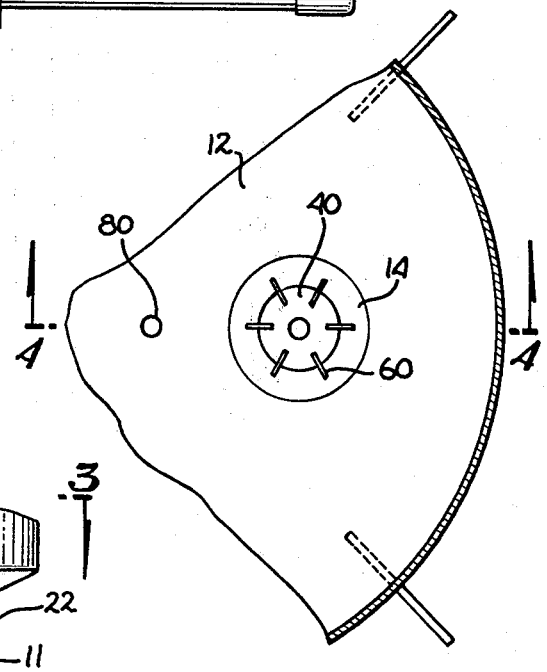
FIG. 3 is a top view of the invention of FIGS. 1 and 2 taken along lines 3—3 of FIG. 2.
Figure 4:
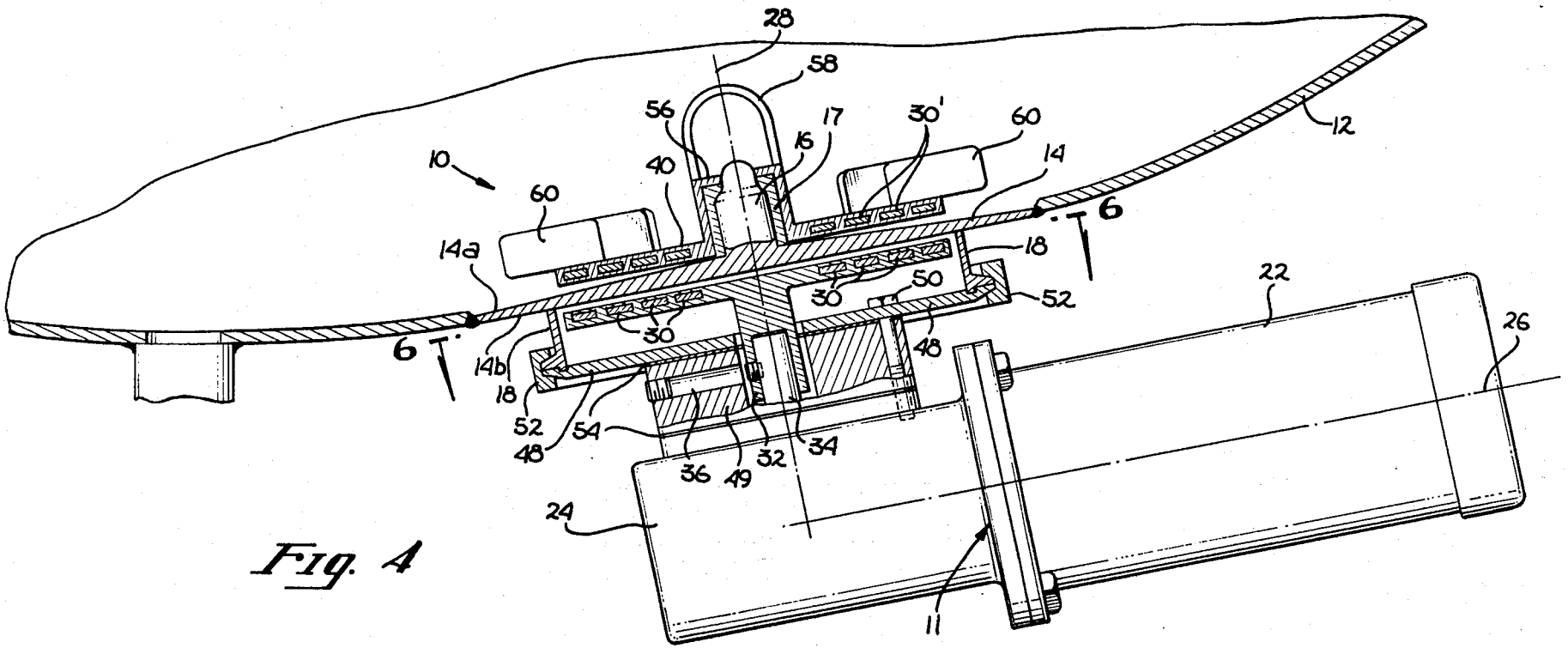
FIG. 4 is a side, cross-sectional view of said invention taken along the lines 4—4 of FIG. 3.

In FIGS. 1–4, a first embodiment of the present invention is shown. This embodiment is suitable in applications which permit the fluid vessel to be cut into in order to install the invented apparatus. With reference to FIGS. 1 and 4, the basic components comprising a magnetically driven fluid agitation apparatus 10; installed in a vessel 12, are shown. A vessel plate 14 is welded or otherwise fixedly secured in the vessel 12, typically in the bottom portion of the vessel. The plate 14 has affixed on or formed into its upper face 14*a*, i.e., on the face which is internal to the vessel, a "spud" or post 16 whose axis is perpendicular to the plate 14. Fitted over the spud 16 or coated thereon is a thin layer of a suitably low friction material 17, preferably Teflon, which enables the spud 16 to function as a bearing. Spud 16 rotatably supports a driven number 40, which member has affixed to it fluid agitating impellers. With reference to FIG. 4, it should be noted that the internal face 14*a* of vessel plate 14 is inclined downwardly from its center. The purpose of this incline is to cause the fluid to run off, rather than accumulate in the spaces between the vessel plate 14 and the driven member 40. Such accumulations of fluid, if not cleaned out, tend to contaminate subsequent fluids processed. An incline of 0.004 inches per inch from the center is suitable.

Affixed to the bottom face 14*b* of plate 14, i.e., on the face external to the vessel 12, is a flange means 18 adapted to support a drive assembly 11 and a driver member 20 which is driven by the drive assembly 11. Drive assembly 11 comprises a drive means 22, for example, an electrical, hydraulic or compressed air motor, and a gear drive (not shown) contained in a gear housing 24.

Driver member 20 is preferably circular in shape. It is made of a magnetically conductive metal, such as stainless steel or monel. Embedded or encapsulated within the driver member 20 is a plurality of permanent magnets 30 poled alternately, i.e., north, south, north, south, etc. The permanent magnets 30 are disposed in a particular array, typically one which is symmetrical with respect to the dimensions of the driver member 20. A number of arrays of the permanent magnets 30 contemplated by this invention are described hereinbelow. While in this embodiment of the invention, the permanent magnets 30 are shown embedded or encapsulated in driver member 20, the invented apparatus could be configured with the permanent magnets 30 affixed to the top of the driver member 20.

Driver member 20 is mechanically and rotatably coupled to drive means 22 through the gear drive contained in gear housing 24. With reference to FIG. 4, the means by which this is done in this first embodiment is shown. The driver member 20 is affixed to a hollow shaft 32 perpendicularly disposed thereto. Hollow shaft 32 is adapted to fit over a gear drive output shaft 34 extending upwardly from the gear drive housing 24. By means of set screw 36, the shaft 32 is coupled to the gear drive output shaft 34, and therefore, is driven by it. In this manner, driver member 20, which is affixed to the hollow shaft 32, is likewise driven by the rotation of gear drive output shaft 34. The position at which shaft 32 is coupled to the output shaft 34 by set screw 36 determines how close the driver member 20 is to the external face 14*b* of vessel plate 14. This distance is one of the variables which determines the amount of torque transmitted from the driver member 20 to the driven member 40. In addition to the set screw 36, corresponding keyways in shafts 32 and 34 can also be used to couple them in a drive relation. Set screw 36, however, would still be used to establish and hold the distance of the driver member 20 from the vessel plate 14. This distance ranges from 0.020 to 0.060 inches in most applications.

In the embodiment of FIGS. 1–4, the gear drive housing 24 and drive means 22 are mechanically coupled to the flange means 18 of the vessel plate 14 by means of bolts 50 passing through an adapter plate 48 and spacer member 49 into the gear housing 24. Thus, drive assembly 11, spacer member 49, and adapter plate 48, when coupled by bolts 50, form an integral assembly capable of being supported as a unit from the vessel plate 14 by the flange means 18 and a clamp means 52.

It should be noted that adapter plate 48 and spacer member 49 have center openings to allow the gear drive output shaft 34 to pass therethrough, and to provide the necessary clearance for the hollow shaft 32 affixed to driver member 20 to fit over said shaft 34 and rotate freely. It should be also noted that a further opening is provided in spacer member 49 to allow set screw 36 to pass through to its engagement with shafts 32 and 34.

It is also advantageous to have sealing means 54, e.g., gaskets, disposed between the engaging surfaces of (i) the adapter plate 48 and spacer member 49, and (ii) the spacer member 49 and the upper surface of gear housing 24. Such sealing means prevents moisture from reaching the gear drive, and therefore, the corrosion thereof. Moisture is often present when vessels 12 are periodically "hosed down" in production areas.

The spacer member 49 may be made of aluminum or a suitable plastic material. It is machined very accurately in order to ensure that the driver member 20 is aligned substantially in parallel with the external face 14*b* of vessel plate 14 at the desired distance therefrom. (As described above, this distance is determined by the position at which the hollow shaft 32, affixed to the driver member 20 and in receiving engagement with the gear drive output shaft 34 is held by set screw 36.) If the driver member 20 is not parallel to the vessel plate 14 within a close tolerance, the distances therebetween contemplated by the present invention could not be achieved, inasmuch as the edge of the driver member would begin to strike the vessel plate. The power transmission capability of this invention decreases inversely as the distance of the driver member 20 from the vessel plate 14 increases.

Adapter plate 48 is configured to engage corresponding surfaces of flange means 18. When so engaged, adapter plate 48 and flange means 18 are coupled by clamp means 52. Clamp means 52 may be any suitable clamp available in the trade which enables the adapter plate 48 to be conveniently coupled and released from the flange means 18 when required. In this manner, the drive assembly 11 is suspended below the vessel 12, as depicted in FIG. 2, its weight being supported by the vessel plate 14 affixed into the vessel 12.

In connection with the location of the vessel plate 14, and therefore, of the entire fluid agitation apparatus, it is noted that such locations are typically somewhere within one of the four quadrants of the bottom of the vessel 12, as shown in FIG. 3, and not the center 80 of the bottom.

The particular gear drive configuration to be used is a matter of design choice, depending upon (i) the required rate of rotation of the driven member 40 within the vessel 12; and (ii) the magnitude of the torque which must be transmitted thereto. In addition, as can be seen in the embodiment of FIGS. 1–4, the gearing configuration must also effectuate a 90° shift from the axis of rotation 26 of drive means 22 to the axis of rotation 28 of the driver member 20. The design and/or selection of a suitable gear drive is well within the capability of persons having ordinary skill in the field. In one embodiment, a D.C. motor having 1½ horsepower and a rate of rotation of 2500 r.p.m. and a gear drive having a 10:1 gear reduction ratio were successfully used.

The shape and dimensions of the driven member 40 generally correspond to those of the drive member 20. Moreover, it is made of the same magnetically conductive metal, i.e., stainless steel or monel, and has embedded or encapsulated therein an array of high energy product, permanent magnets 30' corresponding to the same type of magnets 30 disposed within driver member 20. A number of arrays of the permanent magnets 30 contemplated by this invention are described hereinbelow. Encapsulation of the permanent magnets 30' within the interior of the driven member 40 is necessary in pharmaceutical, food processing and other applications in which contamination of the fluid in process by the magnetic material is not tolerable. In applications in which the foregoing restraint is not applicable, the invented apparatus could be configured with the permanent magnets 30' affixed to the bottom of the driven member 40.

Driven member 40 has affixed to it, or formed thereon, a hollow shaft 56 having an internal bearing surface. The shaft 56 is adapted to fit over spud 16 in slidable engagement with the bearing material 17. As described above, spud 16 is coated with or has fitted over it a suitable bearing material 17, e.g., Teflon, so that friction between shaft 56 and the spud 16 is substantially reduced and the loss of bearing material into the process fluid kept to a minimum.

It is desirable to affix onto, or form in, shaft 56 an upwardly disposed ring member 58 adapted to being "hooked" from above by suitable hook means. The purpose of ring member 58 is to facilitate the removal of driven member 40 from a large vessel 12 during a cleansing operation by use of said hook means from the top, thereby avoiding the necessity of a person going inside the vessel 12 to do so.

Affixed to the upper surface of the driven member 40 is a plurality of impellers 60 adapted to agitate the fluid in process as the driven member 40 rotates in response to the rotation of the driver member 20. The number, shape, pitch, and location of the impellers 60 are a matter of design choice as a function of the particular parameters of the application; i.e., the desired degree of agitation, fluid viscosity, vessel size, required r.p.m. of the driven member 40, etc. In FIGS. 1 and 4, conventional rectangularly shaped impellers are depicted for purposes of illustration.

The preferred permanent magnets 30 utilized in the present invention are of two types. The first is a ceramic (ferrite) magnetic material having the chemical composition $MO.Fe_2O_3$, where M represents barium, strontium, lead or combinations thereof. Such magnets are available from Indiana General of Valparaiso, Indiana under the trademark "Indox". For higher power transmission capability, rare earth, cobalt permanent magnets are preferred. These are also available from Indiana General under the trademark "Incor." As a result of incorporating magnets 30 having high energy products and coercive forces in the driver member 20 and driven member 40, in the arrays taught by this invention, substantial increases in the power (torque) transmitted to the driven member have been attained.

With reference to FIGS. 5*a* through 5*e*, five preferred arrays of the magnets 30 (and 30') are shown within driver and driven members 20 and 40 respectively. In FIG. 5*a*, the plurality of permanent magnets 30 are disposed equidistantly in a circular array. In this configuration, it is preferable for the circular array of magnets 30 and 30' to be close to the perimeters of the driver and driven members 20 and 40 respectively in order that more magnets 30 can be utilized. The greater the number of magnets 30, the greater the power which can be transmitted from the driver member 20 to the driven member 40. The magnets 30 are poled alternately, north, south, north, south, etc.

In FIG. 5*b*, the magnets 30 (and 30') are disposed in at least two concentric circular arrays, said magnets being equidistant from one another. The magnets 30 and 30' in the outermost circle are aligned on a first set of radii of the driver and driven members 20 and 40 respectively, whereas the magnets in the second (inner) circle are aligned on a second set of radii of said members. The magnets 30 are poled alternately, north, south, north, south, etc. in each circle comprising the array. Obviously, the power transmission capability of the array shown in FIG. 5*b* is greater than that of FIG. 5*a* because of the greater number of magnets utilized.

A third circle of magnets 30 (or more depending upon the size of the magnets) has been included in the array of FIG. 5*b* shown in phantom line. In such an array the magnets in the third circle are also evenly spaced one from the other, but are aligned on the first set of radii only (due to space limitations as the circles of magnets approach the centers of members 20 and 40). In the array(s) of FIG. 5*b*, the magnets 30 and 30' are poled alternately north; south, north, south, etc. in each circle comprising the array.

In FIG. 5*c*, the magnets 30 (and 30') are disposed in at least two concentric circular arrays equidistant from one another. Said magnets 30 and 30' are aligned on the same radii of the driver and driven members 20 and 40, unlike the array shown in FIG. 5*b*. A third circle of magnets (or more depending upon the size of the magnets) has been added, likewise equally spaced from one another. In such configuration, the magnets in the third (innermost) circle are aligned along every other radii of the set of radii along which the magnets of the first two circles are aligned. This is due to a space limitation. As in the above-described arrays, the magnets 30 are poled alternately north, south, etc. within each circle.

In FIG. 5*d*, the magnets 30 and 30' of one polarity are pie-shaped sections of the circular driver and driven members 20 and 40 respectively. The pie-shaped sections are evenly spaced within said members. The material between the preshaped sections 30 is the same magnetic material, but of the opposite polarity, and may occupy the entire intermediate area between said sections.

A variation of the array of FIG. 5*d* is shown in phantom line. In the latter array, pie-shaped magnets 30 (and 30') of alternate polarity are evenly spaced around the perimeters of the driver and driven members 20 and 40 respectively.

In FIG. 5*e*, a pair of concentric helical arrays of magnets 30 (and 30'), evenly spaced and of alternating polarities, is shown. Although, in the latter array, the magnetic members 30 form two helixes, a greater number of helixes is within the scope and contemplation of the invention.

For each of the foregoing arrays of magnets, the particular shape and dimensions of the individual magnetic members 30 are a matter of design choice. Persons having skill in the field will be capable of selecting members having the shape and dimensions suitable for a particular application. Moreover, each of the foregoing arrays provides different power transmission capabilities and characteristics, thereby providing the skilled practitioner of this invention an opportunity to select the array most suitable for his particular application, that is, for any of various degrees of fluid agitation.

The magnetic arrays of FIG. 5*d* provide the maximum transfer of torque because they utilize the maximum amount of magnetic material for a given diameter of the driver and driven members 20 and 40. Thus, these arrays are most suitable for use with high viscosity products, especially when the level of agitation required is high, as in the case of blending, suspension, or homogenizing.

The arrays of FIGS. 5*b* and 5*c* are suitable for the transfer of medium levels of torque when they utilize only two concentric circles of magnets 30. When three circles of magnets are used, higher torque transmissions are achieved, thereby making such configurations suitable for applications in which higher fluid viscosity is encountered and/or relatively high levels of agitation are required.

The arrays shown in FIGS. 5*a* (circular array) and FIG. 5*e* (the helical array) are suitable for light mixing and blending operations in applications which require the transmission of relatively little torque.

A significant point of novelty in the present invention is the alternate poling of the magnets 30 and 30' in the driver and driven members 20 and 40 respectively. The prior art of magnetic drivers teaches the use of magnets having the same polarity on the driver member and corresponding magnets of the opposite polarity on the driven member. This present invention, on the other hand, teaches away from the prior art by disclosing the alternate poling of the magnets 30 in the rotating members 20 and 40. The purpose and result of doing so is to substantially increase the torque transmission capability of magnetic drivers by using the high energy product magnets disclosed above to produce, in addition to generally vertical forces of attraction, significant forces of repulsion in the plane of rotation of the driven member 40, should the driven member 40 slip relative to the driver member 20 due to its encountering momentarily high fluid resistance. This is more fully explained below in connection with the description of the operation of the invented apparatus.

In operation, drive means 22 is coupled to the gear drive output shaft 34 through the gear drive contained within gear housing 24. The hollow shaft 32, affixed to the driver member 20, is coupled to the output shaft 34 by set screw 36, or equivalent means. Gear drive output shaft 34 is driven by drive means 22 and, in turn, it drives the driver member 20, the latter being disposed beneath the vessel plate 14.

The magnets 30 in driver member 20 quickly align themselves with the corresponding magnet 30' of the opposite polarity disposed within the driven member 40. The magnetic force of attraction "locks" the position of the driven member 40 with that of the driver member 20, causing the latter to rotate in unison therewith. In this manner, the torque imparted to the driver member 20 is magnetically transmitted to the driven member 40, enabling the latter to cause the impellers 60 to impact the fluid with sufficient force and with a rate of rotation (r.p.m.) required to achieve the level of fluid agitation sought.

Should the forces of resistance encountered by driven member 40 be too high at any time, it will tend to slip with respect to driver member 20. When such slippage occurs, the torque transmitting capability of the apparatus falls off. However, in the present invention, by virtue of the alternate poling of the magnets 30 and 30' within members 20 and 40 respectively (as configured in the arrays depicted in FIG. 5), any such slippage will cause magnets 30 of one polarity, or portions thereof, to become at least partially opposed, in space relation, to magnets 30' of the same polarity, or portions thereof.

This, in turn, will cause forces of repulsion to appear therebetween at angles displaced from the axis of rotation 28 of said members. A component of such repelling forces, therefore, will lie in the plane of rotation of the driven member 40, thereby causing the driven member 40 to advance or regress, as the case may be, with respect to its direction of rotation until the magnets 30 and 30' of opposite polarity are once again aligned with one another. In other words, the components of the magnetic forces of repulsion in the plane of rotation of the driven member 40 operate to realign members 20 and 40 in opposition to any force of resistance which operates to cause slippage.

It should be understood that other embodiments of the present invention will often be required as a function of the particular application in which agitation of a fluid is a process step. For example, in some applications, an electric motor may be unsuitable because of the presence of an explosive atmosphere in the room in which the vessel 12 is located. In other applications, in which the vessel 12 is being subjected to temperature extremes, a conventional gear drive requiring lubrication of a certain viscocity, may be unsuitable. In such cases, the present invention can readily be re-configured by persons skilled in the field to satisfy such environmental constraints and/or conditions. Thus, for example, an air driven motor or an hydraulic motor can be used in lieu of an electric motor. Gear drives can be eliminated by driving an air motor directly from a compressed air line, or a hydraulic motor by a fluid under pressure.

In addition, in multiple vessel applications, in lieu of permanent drive assemblies, portable drive assemblies, with driver members 20 affixed, can be brought to each vessel and sequentially coupled thereto. Alternately, in such applications, each vessel 12 may have a drive means 22, e.g., a hydraulic motor, permanently affixed to the vessel. A workman can then sequentially connect a hydraulic fluid line from drive means to drive means. In such embodiments of this invention, gear means and permanent fluid lines are eliminated.

Figure 6:
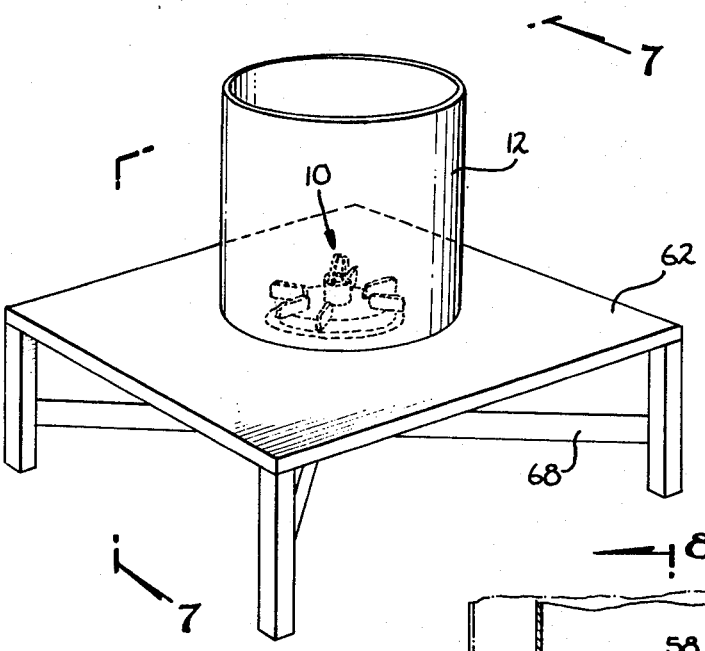
FIG. 6 is a perspective view of a second embodiment of the present invention wherein the internally located driven member is rotatably supported on a bearing means held in place magnetically.
Figure 7:
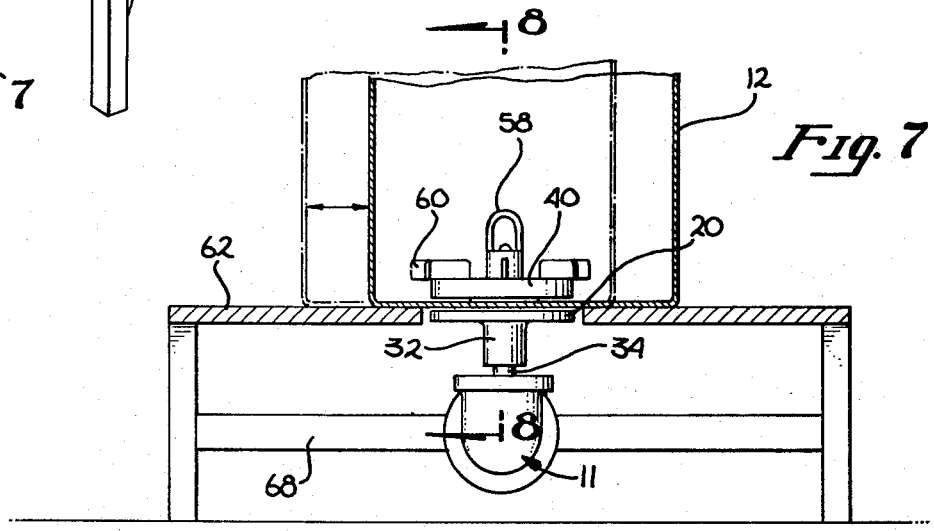
FIG. 7 is a side, cross-sectional view of the embodiment of FIG. 6 taken along lines 7—7 thereof.
Figure 8:
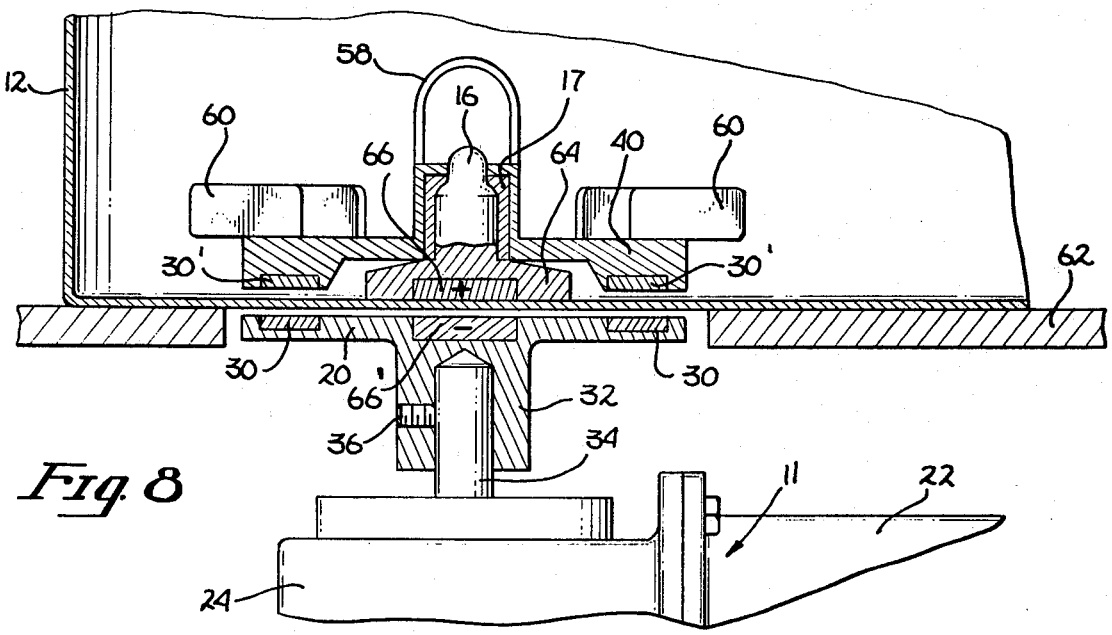
FIG. 8 is a side, cross-sectional view of the embodiment of FIG. 6 taken along lines 8—8 thereof.

In FIGS. 6-8 a second embodiment is shown suitable for an application in which the vessel 12 cannot be cut into in order to accommodate a vessel plate 14. In this application, the vessel 12 is shown supported on a table or platform 62. A support member 64, having disposed within it a magnet 66, is utilized to rotatably support the driven member 40 within vessel 12. Affixed to, or formed in, support member 64 is the spud 16 and its coating or bearing material 17.

In this configuration, drive assembly 11, comprising drive means 22 and gear drive housing 24, is supported below the surface of table 62 by support arms 68. Extending outwardly from housing 24 is gear drive output shaft 34, onto which driver member 20 is secured by set screw means 36. However, unlike in the first embodiment of the invention described above, in this second embodiment, a magnet 66' having a magnetic polarity opposite to that of magnet 66 in the driven member 40, is disposed within the driver member 20. Both magnets 66 and 66' are preferably circular in shape and located within driven and driver members 40 and 20 respectively so that the axis of rotation 28 of said members passes through their centers.

In operation, the drive assembly 11 is first fixedly secured to the table 62 by support arms 68, and the driver member 20 mounted onto the gear drive output shaft 34, so that the upper face of driver member 20 is the desired distance from the bottom of the vessel 12. It should be noted that, for the purpose of transmitting greater power, a circular portion of table 62, of sufficient diameter to enable the driver member 20 to be located directly below the vessel 12, is preferably cut away, such diameter being less than that of the vessel. In this manner, in addition to reducing the distance between the driver and driven members, the intermediate material of the vessel bottom is eliminated, which material may have inferior magnetic permeability than air. Thereafter, the support member 64 is dropped into the vessel 12. Due to the magnetic attraction between magnets 66 and 66', the support member 64 is pulled into coaxial alignment with the driver member 20. Consequently, when the driven member 40 is placed onto the spud 16, its axis of rotation 28 is automatically and properly aligned with that of the driver member 20. Thus, by means of magnets 66 and 66', disposed in the above-described manner within driven and driver members 40 and 20 respectively, the present invention can operate as described above without penetration of the walls or bottom of vessel 12.

Thus, while the invention has been particularly shown and described with reference to two embodiments, it should be understood that various changes in form, detail and application of the present invention may be made by those skilled in the art without departing from the spirit and scope of the invention.

We claim:

1. In an apparatus for agitating a fluid contained in a vessel comprising (i) a driver member rotatably coupled to a drive means and having affixed therein a first plurality of permanent magnetic members; (ii) a driven member rotatably mounted within said vessel coaxially with the axis of rotation of said driver member, and having affixed therein a second plurality of permanent magnetic members; (iii) means for supporting said drive means and driver member external to said vessel and said driven member internal to said vessel; and (iv) impeller means fixedly secured to said driven member, an improvement comprised of:

(a) said magnetic members each being made of materials characterized by high energy products; and (b) said driver and driven members being generally circular and having the same diameter, and said first and second pluralities of magnetic members each being disposed in at least two concentric circular arrays, said magnetic members of said first circular array being evenly spaced one from the other and aligned on a first set of radii of said driver and driven members, and said magnetic members of said second circular array being evenly spaced one from the other and aligned on a second set of radii of said driver and driven members, the magnetic poling of said magnetic members alternating between magnetic north and magnetic south poles, whereby, torque from said drive means is transmitted from said driver member to said driven member by the magnetic forces existing between said first and second pluralities of magnetic members, causing said driven member to rotate in unison with the rotation of said driver member, and said impeller means to agitate said fluid.

2. The improvement of claim 1 wherein a third circular array of said magnetic members of each of said first and second pluralities thereof are evenly spaced one from the other and aligned on said first set of radii.

3. In an apparatus for agitating a fluid contained in a vessel comprising (i) a driver member rotatably coupled to a drive means and having affixed therein a first plurality of permanent magnetic members; (ii) a driven member rotatably mounted within said vessel coaxially with the axis of rotation of said driver member, and having affixed therein a second plurality of permanent magnetic members; (iii) means for supporting said drive means and driver member external to said vessel and said driven member internal to said vessel; and (iv) impeller means fixedly secured to said driven member, an improvement comprised of:

(a) said magnetic members each being made of materials characterized by high energy products; and (b) said driver and driven members being generally circular and having the same diameter, and said first and second pluralities of magnetic members each being disposed in at least two concentric circular arrays, said magnetic members of said first circular array being evenly spaced one from the oother and aligned on a set of radii of said driver and driven members, and said magnetic members of said second circular array being evenly spaced one from the other and aligned on said same set of radii of said driver and driven members, the magnetic poling of said magnetic members alternating between magnetic north and magnetic south poles, whereby, torque from said drive means is transmitted from said driver member to said driven member by the magnetic forces existing between said first and second pluralities of magnetic members, causing said driven member to rotate in unison with the rotation of said driver member, and said impeller means to agitate said fluid.

4. The improvement of claim 3 wherein a third circular array of said magnetic members of each of said first and second pluralities thereof are evenly spaced one from the other and aligned on every other radii of said set of radii.

5. In an apparatus for agitating a fluid contained in a vessel comprising (i) a driver member rotatably coupled to a drive means and having affixed therein a first plurality of permanent magnetic members; (ii) a driven member rotatably mounted within said vessel coaxially with the axis of rotation of said driver member, and having affixed therein a second plurality of permanent magnetic members; (iii) means for supporting said drive means and driver member external to said vessel and said driven member internal to said vessel; and (iv) impeller means fixedly secured to said driven member, an improvement comprised of:

(a) said magnetic members each being made of materials characterized by high energy products; and (b) said driver and driven members being generally circular and having the same diameter, and said first and second pluralities of magnetic members respectively comprising (i) a first set of magnetic members of one magnetic poling, said first set of magnetic members being in the shape of sectors of said driver and driven members and evenly spaced one from the other, and (ii) magnetic material of the opposite magnetic poling disposed between said magnetic members comprising said first set thereof, whereby, torque from said drive means is transmitted from said driver member to said driven member by the magnetic forces existing between said first and second pluralities of magnetic members, causing said driven member to rotate in unison with the rotation of said driver member, and said impeller means to agitate said fluid.

6. The improvement of claim 5 wherein said magnetic material disposed between said first set of magnetic members is in the shape of a set of sectors of said driver and driven members corresponding dimensionally with that of said first set thereof and evenly spaced therefrom.

7. In an apparatus for agitating a fluid contained in a vessel comprising (i) a driver member rotatably coupled to a drive means and having affixed therein a first plurality of permanent magnetic members; (ii) a driven member rotatably mounted within said vessel coaxially with the axis of rotation of said driver member, and having affixed therein a second plurality of permanent magnetic members; (iii) means for supporting said drive means and driver member external to said vessel and said driven member internal to said vessel; and (iv) impeller means fixedly secured to said driven member, an improvement comprised of:

(a) said magnetic members each being made of materials characterized by high energy products; and (b) said driver and driven members being generally circular and having the same diameter, and said first and second pluralities of magnetic members each being disposed in at least two concentric helical arrays, said magnetic members within each helical array being evenly spaced one from the other, the magnetic poling of said magnetic members alternating between magnetic north and magnetic south poles, whereby, torque from said drive means is transmitted from said driver member to said driven member by the magnetic forces existing between said first and second pluralities of magnetic members, causing said driven member to rotate in unison with the rotation of said driver member, and said impeller means to agitate said fluid.

8. In an apparatus for agitating a fluid contained in a vessel comprising (i) a driver member rotatably coupled to a drive means and having affixed therein a first plurality of permanent magnetic members; (ii) a driven member rotatably mounted within said vessel coaxially with the axis of rotation of said driver member, and having affixed therein a second plurality of permanent magnetic members; (iii) said magnetic members each being made of material characterized by high energy products; (iv) said first and second pluralities of magnetic members being disposed in corresponding symmetrical arrays within said driver and driven members respectively, the magnetic poling of said magnetic members alternating between magnetic north and magnetic south poles; and (v) impeller means fixedly secured to said driven member, improved means for supporting said drive means and driven member external to said vessel and said driven member internal to said vessel, comprising:

(a) a vessel plate fixedly secured in said vessel, said vessel plate having affixed on the face thereof internal to said vessel a bearing means, and on said face thereof external to said vessel a flange means extending therefrom;

(b) an adapter plate arranged and configured to engage said flange means;

(c) a spacer means disposed between said adapter plate and a housing of said drive means;

(d) means for fixedly securing said adapter plate to said drive means housing through said spacer means; and (e) clamp means for removably affixing said adapter plate to said flange means of said vessel plate;

whereby said drive means is suspended from said vessel and said driven member is rotatably supported by said bearing means, and torque from said drive means is transmitted from said driver member to said driven member by the magnetic forces existing between said first and second pluralities of magnetic members, causing said driven member to rotate in unison with the rotation of said driver member, and said impeller means to agitate said fluid.

9. The improvement of claim 8 wherein drive means comprises a gear drive having an output shaft extending outwardly from said housing, said driver member being coaxially affixed to said gear drive output shaft at a position thereof which places the face of said driver member at a pre-determined distance from said vessel plate, and said spacer means causes the axis of rotation of said driver member to be substantially perpendicular to said vessel plate.

10. The improvement of claim 9 having in addition thereto sealing means disposed between said adapter plate and said spacer means on a first side thereof, and between said drive means housing and said spacer means on a second side thereof, whereby said driver member and said gear drive are protected from water and moisture.

11. The apparatus of claim 8 wherein the surface of said vessel plate disposed internal to said vessel is inclined away from its center, whereby fluid tends to run off said vessel plate by gravity flow.

12. In an apparatus for agitating a fluid contained in a vessel comprising (i) a driver member rotatably coupled to a drive means and having affixed therein a first plurality of permanent magnetic members; (ii) a driven member rotatably mounted within said vessel coaxially with the axis of rotation of said driver member, and having affixed therein a second plurality of permanent magnetic members; (iii) said magnetic members each being made of materials characterized by high energy products; (iv) said first and second pluralities of magnetic members being disposed in corresponding symmetrical arrays within said driver and driven members respectively, the magnetic poling of said magnetic members alternating between magnetic north and magnetic south poles; and (v) impeller means fixedly secured to said driven member, improved means for supporting said drive means and driven member external to said vessel and said driven member internal to said vessel, comprising:

(a) a support member having affixed thereon bearing means and a first magnet disposed therewithin coaxially with the axis of said bearing means, said support member being located within said vessel; and (b) a second magnet disposed within said driver member coaxially with its axis of rotation, the magnetic polarity of said second magnet being opposite that of said first magnet, whereby, said support member is held in place by the magnetic force of attraction between said first and second magnets, the axis of said support member is aligned with that of said driver member, and said driven member is rotatably supported by said bearing means, and torque from said drive means is transmitted from said driver member to said driven member by the magnetic forces existing between said first and second pluralities of magnetic members, causing said driven member to rotate in unison with the rotation of said driver member, and said impeller means to agitate said fluid.

* * * * *